United States Patent [19]

Kolvites et al.

[11] Patent Number: 4,811,670

[45] Date of Patent: Mar. 14, 1989

[54] SHELF SUPPORT SYSTEM HAVING A TRIANGULAR SUPPORT POST

[75] Inventors: Albert Kolvites, Mountaintop; Rodney E. Brancher, Wyoming, both of Pa.

[73] Assignee: Intermetro Industries Corporation, Wilkes-Barre, Pa.

[21] Appl. No.: 77,645

[22] Filed: Jul. 24, 1987

[51] Int. Cl.[4] ..... A47B 9/08

[52] U.S. Cl. ..... 108/107; 108/111; 108/144; 211/187

[58] Field of Search ..... 108/111, 110, 106, 107, 108/144, 153; 211/187, 190, 207, 208; 248/412, 219.4, 423, 245, 246

[56] References Cited

U.S. PATENT DOCUMENTS

| | | | |
|---|---|---|---|
| Re. 28,293 | 1/1975 | Bustos . | |
| 3,481,486 | 12/1969 | Squires | 108/106 |
| 3,523,508 | 8/1970 | Maslow | 108/144 |
| 3,604,369 | 9/1971 | Maslow | 108/144 |
| 3,851,600 | 12/1974 | Kohl | 108/144 |
| 3,874,511 | 4/1975 | Maslow | 108/144 X |
| 3,885,846 | 5/1975 | Chuang et al. | 108/110 X |
| 3,915,101 | 10/1975 | Onori | 108/106 X |
| 3,964,404 | 6/1976 | Mueller et al. | 108/144 |
| 3,981,250 | 9/1976 | Anthony | 108/106 |
| 4,079,678 | 3/1978 | Champagne | 108/144 X |
| 4,132,178 | 1/1979 | Mueller et al. | 108/106 X |
| 4,138,953 | 2/1979 | Tashman | 108/144 |
| 4,158,998 | 6/1979 | Clement | 108/144 |
| 4,237,798 | 12/1980 | Welsch et al. | 108/111 |
| 4,257,333 | 3/1981 | Pollack | 108/111 X |
| 4,582,001 | 4/1986 | Leikarts | 108/106 |
| 4,593,826 | 6/1986 | Bustos | 108/144 X |
| 4,615,278 | 10/1986 | Cabrelli | 108/144 X |
| 4,629,077 | 12/1986 | Niblock | 108/144 X |
| 4,637,323 | 1/1987 | Nicely | 108/111 X |
| 4,638,745 | 1/1987 | Sheffer | 108/111 |
| 4,656,952 | 4/1987 | Schweizer | 108/144 X |
| 4,706,576 | 11/1987 | James | 108/110 X |

*Primary Examiner*—Kenneth J. Dorner
*Assistant Examiner*—José V. Chen
*Attorney, Agent, or Firm*—Fitzpatrick, Cella, Harper & Scinto

[57] ABSTRACT

A shelf support system for a "knock-down" type shelving system having adjustable height shelves includes a support post having a generally right equilateral triangular cross-section. A wedge member is disposed on the interior face of the support post by a snap-on operation, and is located at a predetermined height thereon by detent apparatus cooperating therebetween. A corner bracket is structurally associated with a corner of the shelf to be supported, and is formed with a tapered face for cooperating with the wedge member. A snap-on collar is provided for forming together with the corner bracket a triangular sleeve around the support post, the collar resiliently engaging the corner bracket, such that the sleeve may be seated on the wedge member by wedge action, thus the shelf may be supported on the support post at the predetermined height.

37 Claims, 6 Drawing Sheets

SHELF SUPPORT SYSTEM HAVING A TRIANGULAR SUPPORT POST

BACKGROUND OF THE INVENTION

1. Field of the Invention

The present invention relates generally to shelving systems, and more particularly to an improved shelf support system for a "knock-down" type shelving system. The shelf support system of the present invention incorporates a support post having a generally triangular cross-section for efficiently maximizing the available shelf space while providing multidirectional stability to the support system. A single-face snap-on wedge member, having detent means which cooperate with the support post, adjustably locates the wedge member at a predetermined height thereon. A corner bracket, structurally integrable with a corner of the shelf to be supported, is tapered to cooperate with the wedge member, thus to locate and support each shelf corner relative to the wedge member. A collar, structurally cooperating with the corner bracket by a snap-on operation, and forming therewith a generally triangular sleeve about the support post, stably locates and supports the shelf corner at the predetermined height by wedge action, and permits the insertion or removal of a shelf located in the interior of the shelving system, without removing adjacent shelves or partially disassembling the shelving system.

2. Description of the Prior Art

Shelving systems having adjustable height shelves and so called "knock-down" type shelving systems are known, and each has utility in many applications. Further, a knock-down type shelving system which also has adjustable height shelves has great utility in a number of applications, including the food service industry. For example, such shelving systems may be used for efficiently storing and transporting a wide variety of food items, of various sizes, shapes and weights.

Various so called "knock-down" type shelving systems which also have adjustable height shelves are known. In particular, there is known a shelving system utilizing a support post having a polygonal or circular cross-section, and at least one shelf having corner assemblies in which a complimentary bore sleeve) is formed therethrough for receiving the support post. A wedge member is then disposed on each support post, between the support post and the respective bore of the corner assembly, for providing shelf support at a predetermined height of the support post by wedge action therebetween.

U.S. Re. Pat. No. 28,293 relates to such a shelf support system in which a vertical support post has a polygonal cross-section. More particularly, this patent discloses a shelf support system utilizing a support post having a square cross section. A one piece wedge member is adjustably supported on two adjacent sides of the support post by locator means. The locator means includes a series of evenly spaced slots disposed on the support post, and a hooked finger disposed on the wedge member, such that the wedge member may be located at a predetermined height on the support post by hanging the wedge member in a corresponding predetermined slot of the support post by its hooked finger. The complementary hole of the corner structure is designed to define two tapered faces corresponding with, and complementary to, the two tapered faces of the wedge member, such that each tapered face of the shelf corner hole may be seated against a tapered face of the wedge member. In this manner, the shelf is wedged in place relative to the support post substantially at the desired vertical position where the wedge member is disposed on the support post. This design therefore prevents the shelf from dislodging downwardly when a load is positioned on top of the shelf, but permits the shelf to be lifted upwardly from the wedge member if it is desired to adjust the height of the shelf or disassemble the shelf structure. Further, the square cross-section of the support post, having support post walls parallel to the edges of the shelf, provides stability to the shelf support system and the shelving system in those directions.

U.S. Pat. Nos. 3,523,508, 3,874,511, and 4,138,953 all relate to shelving systems utilizing a shelf support system in which the support posts have a circular cross-section. In these shelf support systems, each corner assembly of a shelf is provided with a bore therethrough defining a frusto conical sleeve. A wedge or collar member having a coaxial cylindrical inner bore and a frusto-conical outer face is then disposed around the support post, between the support post and the frusto conical sleeve of the shelf. The wedge member may be formed of two semi-cylindrical halves which mate, and is generally provided with an inwardly projecting bead which mates with a corresponding groove formed in the support post. In this manner, the wedge member, and thus the shelf which is supported thereon by wedge action, is located on the support post at a desired height. Further, as the wedge action operates uniformly in a radial direction in the plane of the shelf, the shelf support system provides multidirectional stability to the shelf support system and the shelving system.

U.S. Pat. No. 3,604,369 also relates to a shelf support system in which the support post has a circular cross section In the patent, a keyway is formed in the sleeve of a shelf corner and mates with a key. The keyway and key are both tapered away from the cylindrical post in a downward direction so as to wedge the sleeve and corner post together when a shelf mounted on the sleeve is assembled with the corner post.

Although each of these systems has great utility in many applications, each suffers a drawback in that the shelf support system does not allow for the insertion or removal of an interior shelf of a plurality of shelves without the removal of adjacent shelves and at least partial disassembly of the overall shelving system. Further, as the corner assemblies of each shelf are designed with a hole therethrough, for reception of the support posts, a tradeoff occurs between available shelf space and the stability of the shelving system. In a "circular" type support system, shelf space is sacrificed by enlarging the circular diameter or moving the hole inwardly to assure the stability of the shelving system. In the "square-hole" type support system, shelf space is sacrificed due to the geometry of the support post, which extends into the interior of the shelf.

Shelving systems in which an interior shelf may be added or removed are known. For example, U.S. Pat. Nos. 4,637,323; 4,615,278; 4,582,001; and 4,079,678 all relate to such systems, which incorporate corner posts and cooperating shelves each having a corner structure that engages a portion of the outer peripheral surfaces of a corner post and interengages with an element that embraces the remainder of the outer peripheral surface of the post in the region of the shelf. These systems are all characterized by difficult assembly since it is inherently difficult to align each of the embracing elements with each of the corner posts and shelf to engage all three components together at the same time.

For these and other reasons, a need exists for an improved shelf support system for a knock-down type shelving system, in which the shelves may be easily adjusted to different heights, and wherein an interior shelf may be inserted or removed from the shelving system without removing adjacent shelves or at least partially disassembling the overall shelving system, and wherein the system may be easily assembled and disassembled both initially and thereafter.

SUMMARY OF THE INVENTION

It is therefore an object of the present invention to provide an improved knock-down type shelving system having a shelf support system in which the height of the shelves is easily and accurately adjustable.

It is another object of the present invention to provide an improved knock-down type shelf support system which allows for insertion and removal of an interior shelf without removing adjacent shelves or at least partially disassembling the overall shelving system.

It is another object of the present invention to provide an improved knock-down type shelf support system of simple design, requiring no special tools to assemble, to insert or remove interior shelves, or to adjust the height of the shelves.

It is still another object of the present invention to provide an improved knock-down type shelf support system of simple design, which is inexpensive to manufacture and easily adaptable to conventional shelf technology.

It is yet another object of the present invention to provide an improved knock-down type shelf support system which efficiently maximizes available shelf space in a stable design.

These objects and further advantages are achieved by the present invention, which is an improved shelf support system including a support post having a geometry which provides multidirectional stability to the shelving system, particularly in the direction of the critical stress forces thereof, a wedge member which is removably disposed on one face of the support post and easily adjustable to a predetermined position thereon, and apparatus for capturing the support post and wedge member such that a shelf supported thereby is securely and stably, yet adjustably and removably, supported at the predetermined position on the support post.

More particularly, the shelf support system of the present invention includes a support post having a generally right eguilateral triangular cross-section. The right angular apex faces the exterior of the shelving system and the adjacent flat exterior sides of the support post are arranged parallel to the edges of the shelf, thus providing multidirectional stability, particularly in the directions of the critical stress forces parallel to the edges of the shelf.

A plastic wedge member is molded with resilient contoured lips for removably disposing the wedge member on the interior face of the support post by a clip-on operation. Further, the wedge member includes a viewing window, a shelf height indicator and detent tabs which, in cooperation with detent steps provided on the interior face of the support post, adjustably and precisely locate the wedge member on the support post at a desired position.

A resilient collar detachably engages a tapered corner bracket structurally associated with a corner of a shelf, and together therewith forms a sleeve around the support post, such that when the collar and corner bracket assembly is translated down the support post to seat on the wedge member, it securely and stably supports the shelf at the predetermined position on the support post by wedge action.

A more complete appreciation along with an understanding of other objects, features, and advantages of the present invention will become apparent from the following detailed description when considered in conjunction with the accompanying drawing.

BRIEF DESCRIPTION OF THE DRAWING

FIG. 2 further illustrates an alternative embodiment of the present shelf support system, wherein a solid shelf and bracket are integrally formed of folded sheet metal;

FIG. 6 an exploded top plan view of a second alternative embodiment of the present shelf support system, wherein the shelf is composed of a composite material and the corner bracket is integrally formed therein, and wherein the collar and corner bracket snap together using an interlocking "shark-gill" arrangement;

FIG. 7 is a partial top view of the collar shown in FIG. 6, sectioned to illustrate the cross-sectional geometry of the "shark-gill" slots formed therein; and FIG. 8 is an exploded side view of the collar and corner bracket shown in FIG. 6, illustrating the interlocking "shark-gill" arrangement thereof.

DETAILED DESCRIPTION OF THE PREFERRED EMBODIMENT

For the purpose of explanation only, and to illustrate in part how the present invention may be adapted easily to conventional shelving technology, a shelf support system of the present invention will be presented for three shelf embodiments, namely a wire frame shelf; a solid shelf formed by folded sheet metal; and a composite shelf (e.g. an integrally molded composite plastic shelf). More specifically, a shelf support system for a wire frame shelf will first be disclosed in detail. A shelf support system for a solid sheet metal shelf and a composite plastic shelf will then be disclosed by setting forth modifications to the shelf support system for the wire frame shelf.

Figure 1:
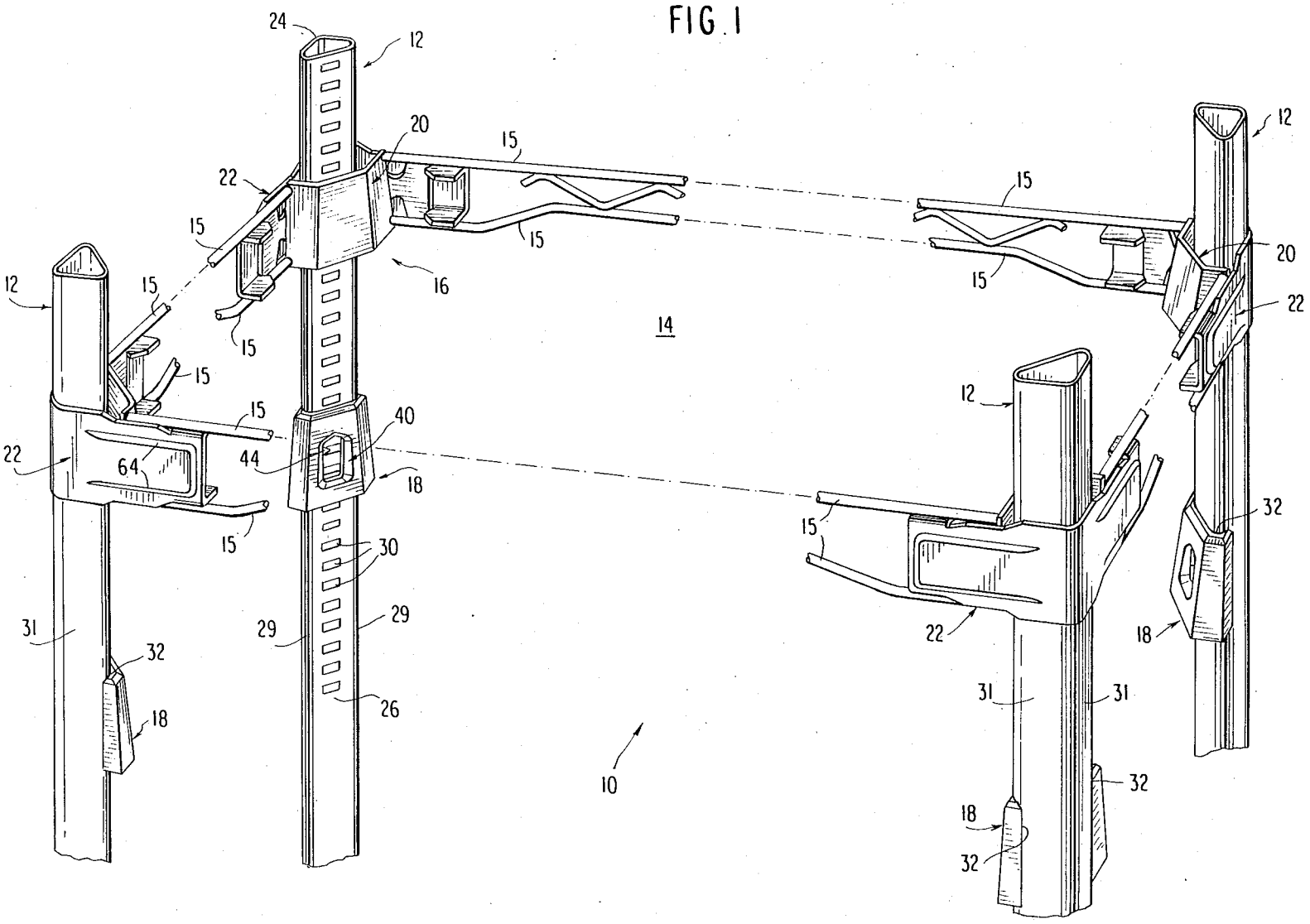
FIG. 1 is a partial perspective view of a shelving system incorporating a preferred embodiment of the shelf support of the present invention.

Referring now to FIG. 1 the shelving system 10 generally includes four support posts 12 arranged to support a wire frame shelf 14 (shown partly in phantom) at corner assemblies 16 thereof. The general structure of a wire frame shelf 14 is well known (see e.g. U.S. Pat. No. 3,523,508 mentioned above). Further, although only a single shelf 14 is shown in FIG. 1, it will be appreciated that a plurality of such shelves 14 may be supported on the support posts 12 in the same manner.

As will be discussed in greater detail below, each corner assembly 16 incorporates the shelf support system of the present invention and includes a support post 12, a wedge member 18, a corner bracket 20 structurally associated with the shelf 14, and a collar 22. As shown in FIG. 1, each collar 22 together with its respective corner bracket 20 forms a sleeve around the respective support post 12, such that the sleeve may be translated downwardly to seat against its respective support post 12 and wedge member 18. In this manner, the shelf 14 may be located and supported by wedge action at a predetermined height corresponding to the placement of the wedge member 18 on the support post 12.

Also for the purpose of explanation only, the elements of each shelf support system of the present invention will be defined with reference to the shelf to be supported, i.e. the term "interior" corresponds to the area defined by the interior of the shelf, or facing therein, and the term exterior corresponds to the area outside of the shelf, or facing therefrom.

Figure 2:
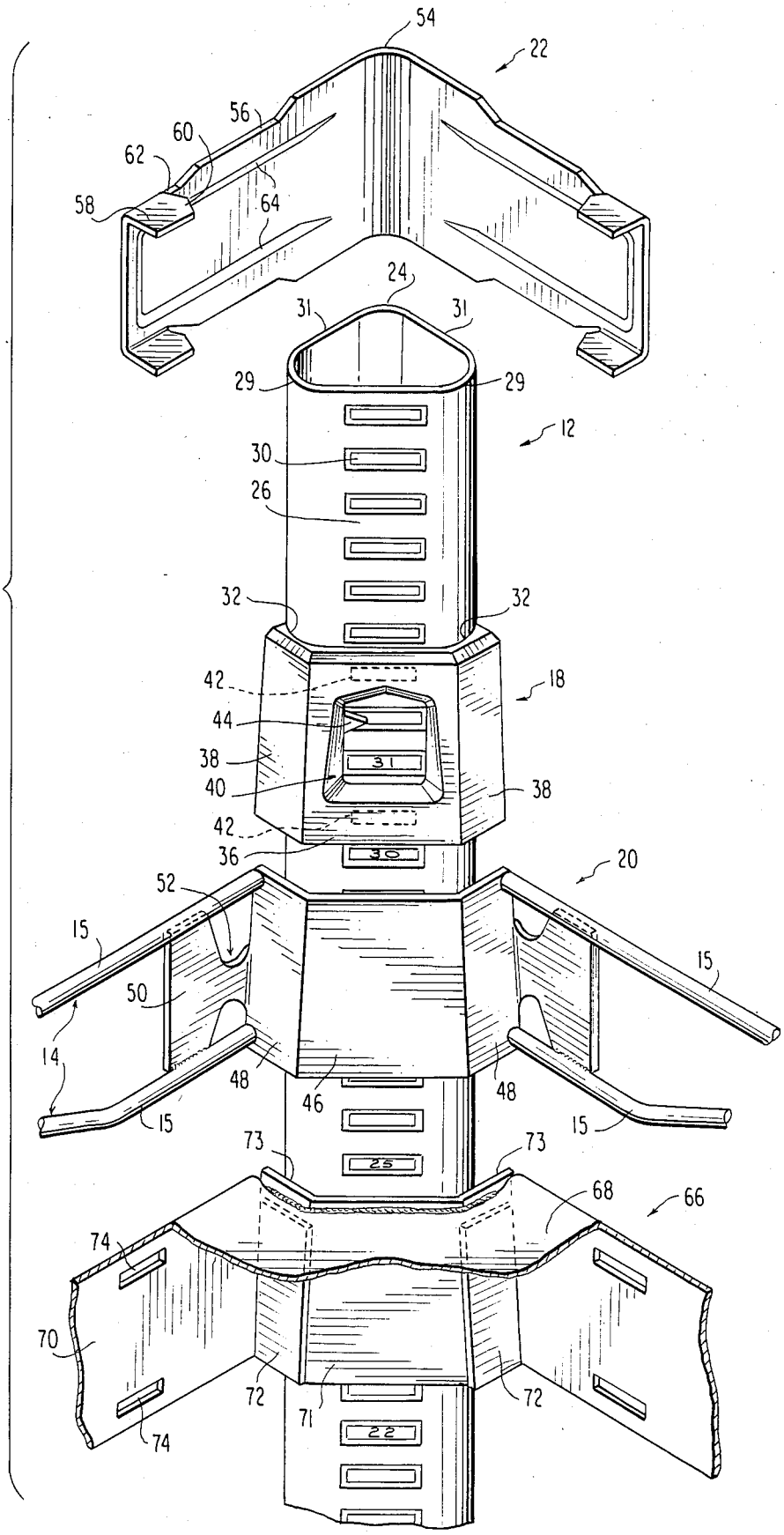
FIG. 2 is a perspective view of one corner assembly of the preferred embodiment shown in FIG. 1, as viewed from the interior of the shelf, and exploded to illustrate the features of a support post, a collar, a wedge member, and a winged corner bracket structurally integrated with a wire frame shelf.
Figure 3:
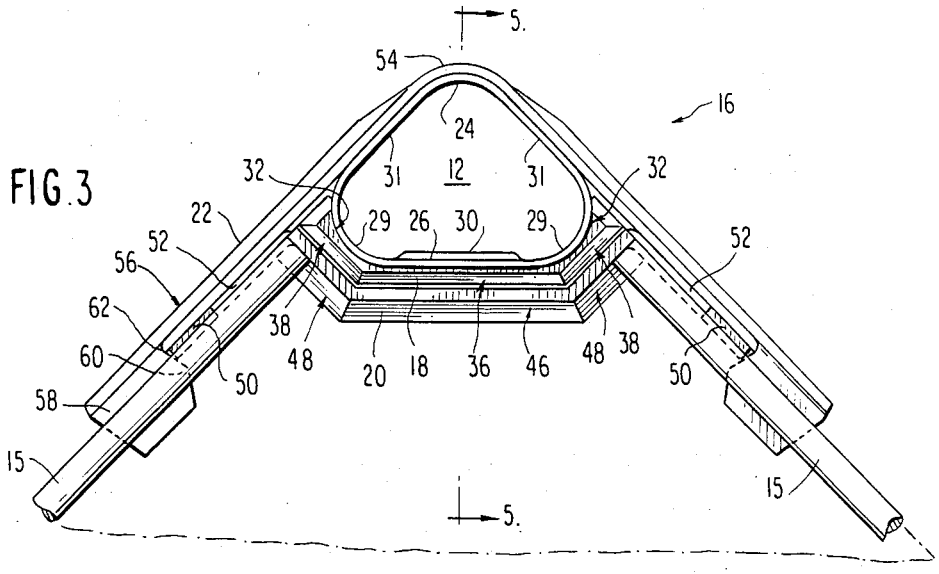
FIG. 3 is a top plan view of the corner assembly of FIG. 2, illustrating the shelf support system of the present invention utilizing a wire frame shelf.
Figure 4:
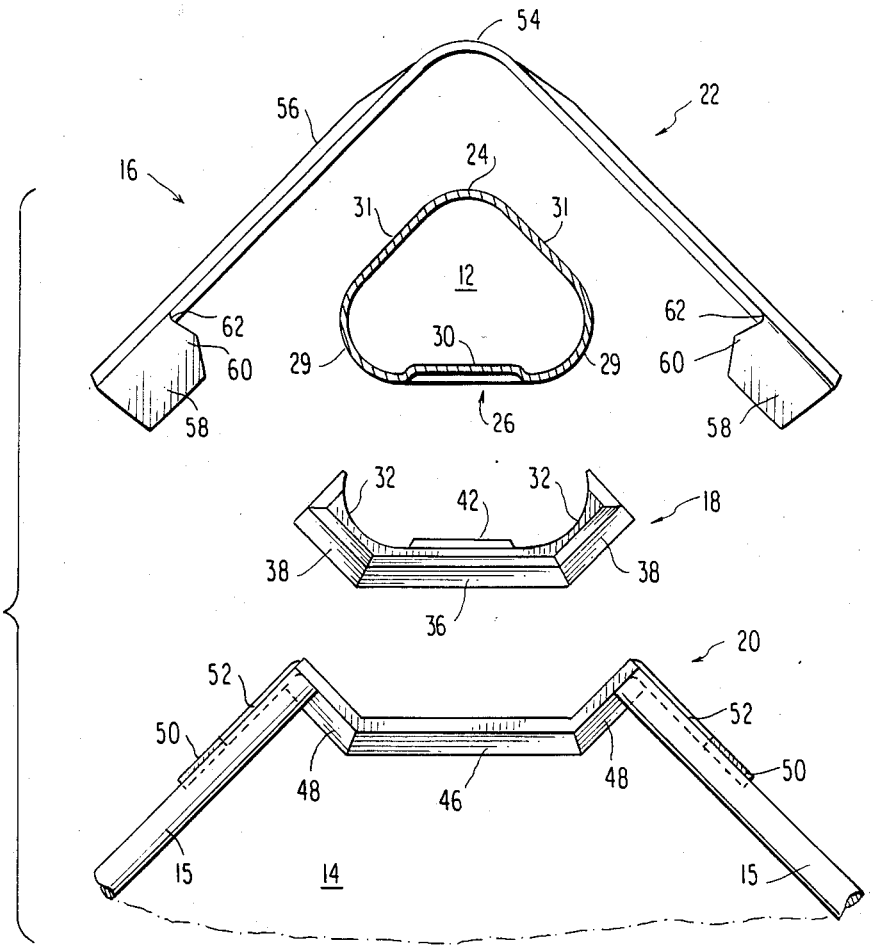
FIG. 4 is an exploded top plan view of the corner assembly of FIG. 3, the support post being shown in cross-section to illustrate the detent features of the support post and wedge member.

Referring now to FIGS. 2, 3 and 4, a corner assembly 16 of FIG. 1 is shown in an exploded perspective view, a top view, and an exploded top view, respectively, illustrating in greater detail the elements of the preferred embodiment of the shelf support system of the present invention. In general, the preferred shelf support system of the preferred embodiment includes the support post 12 having a triangular cross-section, a wedge member 18 which clips onto the interior face 26 of the support post 12, a corner bracket 20 fixed to a wire frame shelf 14 (shown partially in phantom) and tapered to cooperate with the wedge member 18, and a collar 22 for forming together with the corner bracket 20 a triangular sleeve about the support post 12.

As most clearly shown in FIG. 4, the support post 12 has a right eguilateral triangular cross-section, in which the angular apexes are rounded. The right angular apex 24 and the two flat exterior sides 31 face the exterior of the corner assembly 12 (i.e. face the exterior of the shelving system), and the two interior angle apexes 29 (formed symmetrically about line 5—5 of FIG. 3) and the interior face 26 of the support post 12 face the interior of the corner assembly 12.

In a preferred embodiment, each angular apex has a radius of 0.375 inch, and the distance from each interior angle apex 29 to its side opposite, along a line parallel to the exterior side adjacent, is 1.457 inch. However, these dimensions clearly may be changed to accommodate a specific application of the present invention.

Although the support post 12, and thus the shelf support system, is shown herein to be symmetrical, it will be appreciated that the geometry of the support post, and thus the shelf support system, may be varied from symmetry without deviating from the inventive concept, provided that the respective geometries of the support post and the shelf support system are complementary.

Referring now to FIGS. 2 and 3, a series of detent steps 30 are formed at periodic intervals along the vertical length of the interior face 26 of the support post 12 (see also FIG. 1). In the preferred embodiment, these detent steps 30 are formed every ½ inch, such that the height of the shelves in the shelving system may be set at predetermined intervals of ½ inch, although the periodic rate clearly may be varied to suit a particular application of the shelving system.

For further convenience, the detent steps 30 are sequentially numbered, facilitating easy location of each shelf corner at the same height on its respective support post 12 as discussed in greater detail below. In the preferred embodiment, the detent steps are sequentially numbered in whole inch intervals. Accordingly, only every other detent step is numbered.

Referring now to FIGS. 1 and 3, it will be noted that the flat exterior sides 31 of the triangular cross-section of each support post 12 are parallel to the sides of the shelf 14. Accordingly, the triangular geometry of the shelf support system provides structural rigidity to the shelf support system and the shelving system in these directions.

The preferred material for the support post 12 is metal, most preferably cold-rolled steel or stainless steel sheet. These compositions are relatively lightweight, provide high structural rigidity, and are inexpensive to manufacture by known metal forming methods. Further, stainless steel is resistant to corrosion and easily cleaned, so that it may be utilized in many applications, including food service applications. Still further, the detent steps 30 may be efficiently formed therein, using known metal forming methods such as punching or pressing.

Alternatively, the support post 12 may be composed of any conventional material which can be formed to define the above features, particularly including conventional materials such as plastics. Further, the support post may be solid or hollow. Such alternative compositions may be well suited to particular shelving system applications.

Referring again to FIG. 2, the wedge member 18 is designed to clip on to the support post 12 across only the interior face 26 thereof. The face of the wedge member 18 adjacent the support post 12 is contoured to interfit therewith, including a contoured lip 32 disposed on each of two opposing edges of the wedge member 18 for resiliently embracing each interior angle apex 29 of the support post 12, for resiliently clipping the wedge member 18 onto the support post 12 (see also FIGS. 3 and 4).

Detent tabs 42 are provided on the face of the wedge member adjacent the interior face 26 of the support post 12 and are spaced at intervals corresponding to the spacing of the detent steps 30 of the support post 12. The configuration of the detent tabs 42 is designed to mate with the configuration of the detent steps 30 (see particularly FIGS. 2, 4 and 5, the support post of FIG. 4 being shown in cross section through a detent step 30 more clearly to illustrate this complementary fit).

Although two detent tabs 42 are shown in the preferred embodiment, the wedge member 18 may comprise one or more detent tabs 42. Further, both the number and the size of the detent tabs may be varied for a number of reasons, including for example the size of the wedge member 18, the size and spacing of the detent steps 30, and the shelving application.

A detent tab 42 provides vertical support when it is seated in a detent step 30. It further locates the wedge member 18 on the support post 12. Vertical support is also provided by wedge action as will later be discussed. It will therefore be appreciated that the wedge member 18 may be clipped onto the support post 12 at any incremented height, and further may be translated up and down to any other incremented height thereon. However, the detent tabs 42 may be used to locate the wedge member 18 at a specific predetermined height on the support post 12.

The face of the wedge member 18 adjacent to the corner bracket 20 is angled at each of the two opposing edges to form a wedge portion 36 proximate the interior face 26 of the support post 12, and two side wedge portions 38, one located at each of the two opposing sides of the central wedge portion 36 and proximate the interior angle apexes 29 of the support post 12 (see particularly FIG. 3). The side wedge portions 38 are generally disposed in planes perpendicular to each other, each side wedge portion 38 also being generally parallel to the adjacent exterior side 29 of the support post 12. As will be discussed in greater detail below, this orientation provides a multidirectional stabilizing force, particularly in the directions corresponding to the sides of the shelf.

Referring again to FIG. 2, a window 40 is formed in the central wedge portion 36, for viewing the detent steps on the interior face 26 of the support post 12, thus for locating the wedge member 18 on the support post 12. A shelf height indicator 44 is formed in the window 40 for indicating the specific height at which the wedge member rests, by pointing to a specific detent step 30. The window 40 is preferrably larger enough to expose two steps 30, so that an indicating number associated with every other step can be always seen.

As may be seen from FIG. 1, reference to the sequentially numbered detent steps 30 permits each of four wedge members 18 to be quickly and precisely located at the same height on each of the four support posts 12, such that a shelf may be supported thereon in a level orientation.

Figure 5:
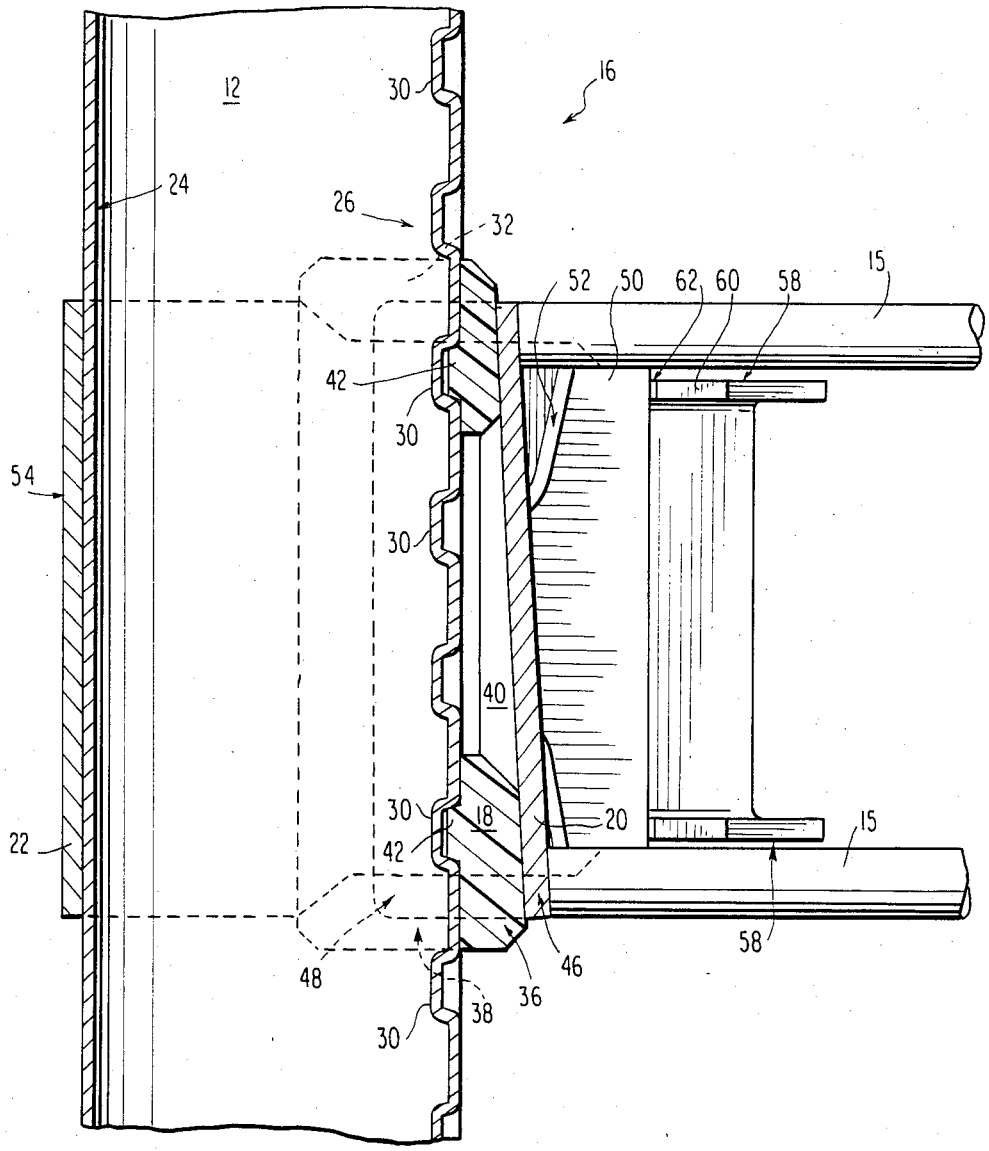
FIG. 5 is a vertical cross-sectional view of the corner assembly taken along plane 5—5 of FIG. 3.

Referring to FIG. 5, the wedge member 18 is tapered from its upper end to its lower end, such that the lower end extends toward the interior of the shelf support system. In the preferred embodiment, the taper is shallow to maximize rigidity and minimize the thickness of the wedge member and thus the amount of interior shelf space occupied thereby. For example, in FIG. 5 the taper is of the order of 3 degrees.

The preferred material for the wedge member 18 is a resilient molded plastic. Such a resilient molded plastic wedge member will translate easily up and down a support post, or alternatively can be easily clipped on to it and off of it. However, other materials which provide the desired resilient characteristics may be used.

Referring again to FIGS. 2 through 4, and particularly to FIG. 4, the corner bracket 20 of the preferred embodiment has a "gull-wing" configuration which mates with the wedge member 18, and includes a tapered face 46 first angled upwardly, as shown in FIG. 4, at each of two opposing sides to form a pair of tapered shoulders 48, and then angled downwardly, as shown in FIG. 4, at each shoulder to form a pair of wings 50. In the area where each wing 50 meets its respective tapered shoulder 48, the upper and lower side edges are contoured to form a narrow neck 52 (see Fig. 2). Each tapered face of the corner bracket 20 corresponds to a respective portion of the wedge member 18. More specifically, each tapered shoulder 48 corresponds to an side wedge portion 38 of the wedge member 18, and the degree of taper of each of these faces corresponds to its respective tapered portion of the wedge member 18.

The corner bracket 20 is made of a conventional material which may be fixed to the wire frame shelf 14. In the preferred embodiment, the corner bracket is composed of metal, most preferably cold-rolled steel, and is fixed to the wire frame shelf 14 by a conventional technique such as welding. For example, as shown in FIGS. 1 through 5, the main side support wires 15 of shelf 14 may be welded to the wings 50 of the corner bracket 20. In this manner, the corner bracket is integrally formed with the wire shelf, comprising the corner structure thereof. This configuration of the main side support wires 15 also provides a guide means for locating the collar 22, as will be discussed below.

Referring again to FIGS. 2 through 4, the collar 22 of the preferred embodiment is a generally flat, rectangular member folded at its center to form a generally right angle which corresponds to the exterior apex 54 of the shelf support system, and thus the shelving system. The exterior apex 54 is rounded to cooperate with the right angular apex 24 of the support post 12. Further, the collar 22 is tapered at its extensions to form a pair of collar arms 56, each terminating in a pair of tabs 58 disposed generally at the four corners of the rectangular collar member. Each tab 58 is folded inwardly at a generally right angle to its respective collar arm 56 to form a tang 60 and a wing notch 62 on its interior side proximate the exterior apex 54. Still further, each collar arm 56 may be formed with ribbing 64, to provide added strength.

The collar 22 may be made of conventional materials by conventional methods. The preferred material is a metal, most preferably cold-rolled steel, which can be cut and formed by conventional metal working methods. This composition yields the desired characteristics of strength with resiliency. However, other compositions which provide the desired characteristics may be used. In particular, a collar having a plastic composition may be desirable for some shelving system applications.

To capture the wedge member 18 and support post 12, thus to support the wire shelf 14 at a desired height, a wedge member 18 is first disposed on the support post 12 at the desired height by a clip-on operation, and located at a specific predetermined height thereon using the detent features of the wedge member 18 and the support post 12, as disclosed above. The wire shelf 14 is then placed within the shelving system above the height of the wedge member 18, and each collar 22 is engaged to each respective corner bracket 20, by a clip-on operation, to form a generally triangular sleeve around each respective support post 12 (see FIG. 1). Each sleeve is then translated down onto the respective wedge member 18 to seat thereon by wedge action.

Of course, for initial assembly of the system, shelves are preferrably provided with collar members already engaged on each shelf. In this way the system may be assembled in the same fashion as is InterMetro Industries SUPER ERECTA shelf system by first position four corner posts appropriately attaching wedge members 18 to each post appropriate heights and lowering shelves down over the posts with one collar embracing each post. The collar 22 is engaged to the corner bracket 20 by the clip-on operation, wherein each wing 50 of the corner bracket 20 is captured in the wing notch 62 formed under the tang 60 of the respective tab 58 (see FIGS. 1, 3 and 5). To assure secure and proper location of each tab 58 relative to the corner bracket 20, the main side support wires 15 of the wire shelf 14 are disposed on each wing 50 to form a guide, wherein the main side support wires 15 lay just inside the respective tabs 58 (see FIGS. 1 and 5).

As shown in FIGS. 3 and 5, the wedge member 18 and support post 12 are captured by the corner bracket 20 and collar 22 by wedge action. As best shown in FIG. 5, as the sleeve is moved downwardly, each tapered face of the corner bracket 20 engages the respective tapered portion of the wedge member 18, and is thereby moved toward the interior of the shelving system by a wedging force. At the same time, the exterior apex 54 of the collar 22 engages the right angular apex 24 of the support post 12, to sandwich the wedge member 18 between the post and bracket. Thus each wing 50 is biased by the wedging force to seat in the wing notches 62. Further, it will be appreciated that the greater the weight on the shelf 14, the greater the downward force, the greater the wedging force, and thus the greater the bias for seating the wings 50 in the wing notches 62. Accordingly, the shelf support system of the present invention does not lose stability as the weight increases. Still further, the wedging force is translated through the wings 50, which extend parallel to the exterior sides 31 of the support post 12. Thus, it will be appreciated that the wedging force is transmitted primarily across the interface of the tapered shoulder 48, the side wedge portion 38 and the interior angle apex 29, and parallel to the exterior sides 31 (see particularly FIG. 3). Accordingly, the triangular geometry of the shelf support system provides particular stability in the directions of critical stress, i.e. in the directions parallel to the edges of the shelf and with additional support provided diagonally by contact of face 36 with surface 46.

Referring again to FIG. 2, an alternative embodiment of the present invention is also illustrated, wherein the shelf support system is adapted for use with a solid shelf 66, a corner thereof being partially shown. In this embodiment, the solid shelf 66 is formed from a single piece of sheet metal, folded to form a shelf top 68 having side walls 70 depending therefrom at its periphery. At each corner of the solid shelf 66, the sheet metal is cut and folded to form a pair of opposing shelf shoulder flanges 72, each projecting at a generally right angle from the side walls 70 to the interior of the shelving system. Each shoulder flange 72 is further formed at an angle relative to vertical, such that it corresponds with the taper of a corresponding side wedge portion 38 of the wedge member 18. Tab locators 74, for engaging the tabs 58 of collar 22, are then formed by cutting slots in the side walls 70. The flanges are joined by a separate metal panel that has surfaces 73, welded to the flanges.

It will be appreciated that the solid shelf 66 thus has a corner bracket comprising the shoulder flanges 72, the side walls 70 , metal panel and the tab locators 74, wherein the method for capturing the wedge member, and thus supporting the shelf, is the same as in the above embodiment.

Referring now to FIGS. 6 through 8, a third embodiment of the present invention is illustrated, wherein the present shelf support system is adapted to a plastic shelf. FIG. 6 illustrates in an exploded top plan view, a sleeve formed by a modified collar 22″ and a plastic shelf 76 (partially shown in phantom) having a corner bracket 20″ integrally molded therein.

The corner bracket 20″ is integrally molded into the plastic shelf 76, and includes a central tapered face 46″, two tapered shoulders 48″, and a recess 94 formed in the side edges of this plastic shelf 76. Similar to the above embodiments, each tapered face and shoulder cooperates with a corresponding wedge portion of the wedge member (not shown in FIGS. 6, 7, and 8).

The modified collar 22″ of the present embodiment is similar in design and operation to the collar 22 in the previous embodiments. However, in the present embodiment, the collar 22″ is provided with upper locator tabs 78 and lower locator tabs 80, formed at the upper and lower edges of its collar arms 56″, respectively, for locating the corner bracket of the plastic shelf therebetween. Further, each collar arm 56″ terminates in a tapered tail 86, which cooperates with a complementary molded notch 88 in recess 94 of the plastic shelf 76, to locate the tail 86 therein. Still further, a plurality of "shark-gill" slots 82 are formed in each collar arm 56″, for engaging a corresponding plurality of "shark gill" projections 84 formed in recess 94 of the plastic shelf 76.

As shown in FIG. 8, each shark gill slot 82 is tapered in width from top to bottom. Further, as shown in FIG. 7, the interior edge 90 of each shark gill slot 82 is angled outwardly, toward the exterior of the shelving system. Likewise, each "shark-gill" projection 84 is tapered in width from top to bottom, and the interior edge 92 of each "shark-gill" projection is angled inwardly, toward the interior of the shelving system. Accordingly, these two angled interior edges mate, and are biased against each other in an interlocking manner, similar to the snap on operation of the bracket wings 50, or alternatively the tab locators 74, and tabs 58 of the previous embodiments.

The corner posts in this and the previously described embodiment might be made of a composite structure such as a resinous material reinforced with continuous fibers pultruded through an annular die.

The configuration of the support post and the wedge member of this embodiment are the same as those in the above embodiments and are therefore not shown here. Further, the method for capturing the wedge member and support post, by translating the sleeve downwardly on the support post to engage and seat on the wedge member, is also the same as in the above embodiments, and is therefore not disclosed here in detail.

It will be appreciated that the triangular geometry of the shelf support system of the present invention provides many advantageous features. Initially, as noted above, the exterior sides of the triangular cross-section support post are flat and parallel to the edges of the shelf to be supported, thus parallel to the primary directions of stress forces experienced by the shelf support system and the shelving system. The triangular geometry thus provides multidirectional stability, yet provides particular stability in the critical directions of the stress forces.

A potential advantage over systems utilizing a circular geometry is the absence of rotation of the support posts. In the present system, the triangular geometry together with the wedge member construction assures that the wedge member will always be captured in the same orientation. This feature, for example, always positions height index numbers in same way facing unconspicuously inwardly of the shelf.

Another advantageous feature of the present invention is that the height of a shelf may be easily changed to accommodate a variety of shelving applications. To change the height of a shelf, the shelf is first moved upwardly to relieve the wedging forces at each corner and to expose the respective wedge members. Each wedge member is then moved upwardly or downwardly on the support post or alternatively clipped-off and then clipped back onto the support post at the desired new height. As each wedge member is provided with detent tabs and a window having a shelf height indicator, and each support post is provided with sequentially numbered detent steps, each wedge member can be quickly relocated on its respective support post at the same, predetermined height. The shelf is then moved downwardly and supported at the new desired height by wedge action. A particular advantage of this feature is that no special tools are required to effect the adjustment of the shelf.

A further advantageous feature of the present invention is the ability to insert and remove an interior shelf from the shelving system without removing adjacent shelves or at least partially disassembling the overall shelving system. To insert an interior shelf, a wedge member is first clipped on to each support post at the desired height. The shelf, having a bracket associated with each corner thereto, is then slightly tilted at an angle to allow insertion between the four support posts, at a position above the wedge members, and a collar is then clipped over each bracket to form a sleeve around each support post. The shelf is then moved downwardly such that each sleeve seats on the respective wedge member to support each corner of the shelf by wedge action. Of course, these steps may be performed in different order to suit the preference of the assembler. Similarly, an interior shelf may be removed without removing adjacent shelves or at least partially disassembling the overall shelving system simply by reversing the above procedure. Again, a particular advantage of this aspect of the present invention is that it requires no special tools to effect the insertion or removal of the interior shelf.

It will also be appreciated that the triangular geometry maximizes the available shelf space without sacrificing stability. As noted above, the triangular geometry provides multidirectional stability, particularly in the directions of the critical stress forces, i.e. in the directions parallel to the edges of the shelf. Further, as is clearly evident from FIG. 3, the triangular support post of the present invention occupies only a small, corresponding triangular section of the shelf corner. Only the thin collar is disposed outside of the support post. In this manner, substantially the entire interior of the shelf may be utilized. Further, as only the thickness of the collar extends outside of the support post, it will be appreciated that a number of shelving units utilizing the shelf support system of the present invention may be arranged adjacent each other, forming substantially continuous shelves therebetween.

Additionally, each of the components of the shelf support system may be easily and inexpensively manufactured using conventional materials and techniques. Although specific examples were disclosed in detail above, other conventional materials and manufacturing techniques may be used according to the application in which the shelving system is to be applied.

Another advantageous feature of the present invention is that the corner bracket 20 may be adapted to accommodate numerous other conventional shelving designs. For example, the bracket may be adapted to support a solid wood or plastic shelf by truncating each corner of the shelf and affixing a corner bracket thereto by a conventional bolt arrangement.

Although specific embodiments of the present invention have been described above in detail, it will be understood that this description is merely for purposes of understanding the present invention. Modification of the preferred embodiments described herein may be made by those skilled in the art without departing from the scope of the present invention which is set forth in the following claims.

What is claimed is:

1. A system for supporting a shelf having a periphery that defines at least one corner and an interior and an exterior of the shelf, said system comprising:

a corner bracket mounted with each said corner of said shelf and having a face portion having at least one surface inclined downwardly and inwardly with respect to said shelf interior;

at least one collar having two sides that define a generally right angular apex;

means for mounting each said collar with one said corner bracket thereby to for an open sleeve having a generally right triangular cross-section, at least a major part of said face portion defining the hypotenuse and said sides of said collar defining the adjacent sides of said generally right triangular cross-section;

a support post having two side surfaces, forming a generally right angular apex, and a hypotenuse surface that together define a generally right triangular cross-section congruent to the cross-section of said sleeve, said post thereby being formed to be received in said sleeve;

a wedge member having at least one inclined face complementary to said inclined surface of said face portion; and means for mounting said wedge member at a fixed location on said hypotenuse surface of said support post and adjacent said face portion of said corner bracket, with said inclined wedge portion of said wedge member inclined downwardly and inwardly with respect to said shelf interior;

whereby downward movement of said shelf with said support post and said wedge member mounted thereon received in said sleeve causes said wedge portion of said wedge member and said inclined surface of said face portion tightly to engage thereby to urge said generally right angular apex of said support post into tight engagement with said generally right angular apex of said collar and said side surfaces of said support post into tight engagement with said sides of said collar.

2. The shelf support system according to claim 1, wherein said hypotenuse surface and side support posts are joined at respective interior angle apexes, and wherein each apex of said support post is rounded.

3. The shelf support system according to claim 2, wherein the radius of curvature of each said apex of said support post is of the order of 0.375 inch, and wherein the distance from each interior angle apex to the opposite side surface, along a line parallel to the adjacent side surface, is of the order of 1.457 inch.

4. The shelf support system according to claim 1, wherein said generally right triangular cross-sections of said sleeve and of said support post are right equilateral triangular cross-sections.

5. The shelf support according to claim 4, wherein each of said support post, said wedge member, said corner bracket and said collar is symmetrical about a plane passing through said generally right angular apex of said collar and normal to the hypotenuse surface of said support post.

6. The shelf support system according to claim 1, wherein said hypotenuse surface of said support post comprises at least one detent step formed thereon, and wherein said wedge member is provided with at least one detent tab corresponding with said at least one detent step for locating said wedge member at said fixed position on said support post.

7. The shelf support system according to claim 6, wherein a plurality of detent steps are periodically disposed on said hypotenuse surface along the length of said support post at a predetermined interval.

8. The shelf support system according to claim 7, wherein the predetermined interval is ½ inch.

9. The shelf support system according to claim 7, wherein the number of detent tabs is two, and wherein said detent tabs are spaced to correspond to said predetermined periodic interval.

10. The shelf support system according to claim 6, wherein the number of detent tabs is two.

11. The shelf support system according to claim 6, further comprising inditia means for sequentially identifying said detent steps.

12. The shelf support system according to claim 11, wherein said face portion of said wedge member is formed with a window for viewing said hypotenuse surface of said support post, and thus for viewing the detent steps formed thereon.

13. The shelf support system according to claim 12, wherein the face portion of said wedge member further comprises a shelf height indicator disposed adjacent said window, and wherein said shelf height indicator indicates the position of the wedge member relative to the support post, and thus the position of the shelf relative to the support post, by indicating a specific d®tent step at which said wedge member is disposed.

14. The shelf support system according to claim 6, wherein said support post is composed of metal, and wherein said detent steps are formed by at least one of punching and pressing.

15. The shelf support system according to claim 1, wherein said wedge member is composed of a resilient material.

16. The shelf support system according to claim 15, wherein said wedge member is composed of plastic.

17. The shelf support system according to claim 1, wherein said support post is composed of roll formed metal.

18. The shelf support system according to claim 1, wherein said support post is composed of cold-rolled steel.

19. The shelf support system according to claim 1, wherein said wedge member comprises three wedge portions, including two side wedge portions each being disposed, when mounted by said wedge mounting mean on said support post, adjacent an apex of said support post defined by said hypotenuse surface and one said side surface, and a central wedge portion disposed adjacent said hypotenuse surface of said support post.

20. The shelf support system according to claim 19, wherein said side wedge portions are disposed in planes substantially perpendicular to each other, and wherein each side wedge portion is substantially perpendicular to an adjacent side surface of said support post.

21. The shelf support system according to claim 19, wherein each said wedge portion is downwardly inwardly inclined with respect to the interior of said shelf at on the order of 3 degrees.

22. The shelf support system according to claim 19, wherein said face portion of said corner bracket cooperates with said central wedge portion, said corner bracket further comprising a tapered shoulder disposed on each of two opposing sides of said face portion and cooperating with one of said two side wedge portions, and wherein when said sleeve is seated on said wedge member and said support post, a wedging force generated between said wedge portion and said corner bracket being transmitted across the engaging surfaces of each side wedge portion and the corresponding tapered shoulder to support said shelf.

23. The shelf support system according to claim 1, wherein said wedge mounting means comprises a resilient contoured lip formed on each of two side edges of said wedge member, and wherein each of said two contoured lips is formed to embrace one apex defined by said hypotenuse surface and one said side surface of said support post thereby to mount said wedge member on said support post by a clip-on operation.

24. The shelf support system according to claim 1, wherein said corner bracket further comprises a tapered shoulder disposed on each of two opposing sides of said face portion and a wing extending from each tapered associated shoulder, each wind being contoured to form a narrow neck at the point where said wing meets the respective associated tapered shoulder.

25. The shelf support system according to claim 24, wherein said face portion and each of said tapered shoulders is downwardly inwardly inclined with respect to said shelf interior at on the order of 3 degrees, the incline extending from the top of the corner bracket to the bottom of the corner bracket and into the shelf interior.

26. The shelf support system according to claim 1, wherein said corner bracket is composed of metal.

27. The shelf support system according to claim 1, wherein said corner bracket is composed of cold-rolled steel.

28. The shelf support system according to claim 1, wherein said corner bracket is integrally formed in said shelf to be supported.

29. The shelf support system according to claim 1, wherein said shelf is a wire frame shelf comprising support wires and wherein said corner bracket is fixed in a corner thereof by fixing a support wire of said shelf to said corner bracket.

30. The shelf support system according to claim 29, wherein said corner bracket is composed of metal, and wherein said wire frame shelf is affixed thereto by welding.

31. The shelf system according to claim 29, wherein said wire frame shelf comprises at least one main side support wire, said at least one main side support wire being affixed to said corner bracket so as to form a guide for locating said collar.

32. The shelf support system according to claim 1, wherein said shelf is composed of sheet metal, and wherein said corner bracket includes a pair of flanges formed by folding and cutting said sheet metal and joined by a panel member.

33. The shelf support system according to claim 1, wherein said shelf is made of molded plastic, and wherein said corner bracket is molded into a corner of said plastic shelf.

34. A shelf support system for a knock-down type shelving system having at least one wire frame shelf defining an interior and an exterior, the shelf support system comprising:

a support post having a generally right uilateral triangular cross-section, the right angular apex being rounded and, together with the two sides adjacent said right angular apex, facing the exterior of said shelf, the two remaining interior angular apexes of said support post being rounded and symmetrically disposed, and the interior face of said support post, disposed opposite said right angular apex, having a plurality of detent steps periodically disposed along the length of the support post at predetermined intervals;

a molded plastic wedge member, having a resilient contoured lip on each of two opposing edges and at least one detent tab disposed to cooperate with said detent steps on said support post, each lip being formed to embrace an interior angle apex of said support post thereby to removably and adjustably dispose said wedge member on said interior face of said support post by a clip-on operation, the wedge member further having a wedge portion tapered to extend from the top of said wedge member to the bottom of said wedge member in the direction of the interior of the shelf, the wedge portion having a central wedge portion extending across said interior face of said support post when said wedge member is mounted thereon and a side wedge portion adjacent each of said interior angle apexes of said support post, said central wedge portion further having avoid therethrough forming a window for viewing said detent steps disposed on said interior face of said support post, and said central wedge portion still further having a shelf height indicator disposed adjacent said window for indicating a detent step, thus for indicating a predetermined position at which said wedge member is located by said at least one detent tab;

a corner bracket fixed to a corner of said at least one wire frame shelf, the corner bracket having a central tapered face angled at each of two opposing side edges to form a pair of tapered shoulders and a pair of wings extending therefrom, each wing extending from one of said tapered shoulders, wherein said central tapered face is complementary to, and cooperates with, said central wedge portion, and each one of said pair of tapered shoulders is complementary to, and cooperates with, a respective side wedge portion, and wherein each tapered shoulder is oriented substantially perpendicularly to an adjacent side of said support post; and a resilient collar having a rounded exterior apex which corresponds to an apex of the shelf, and a pair of collar arms extending therefrom, each collar arm being tapered and ribbed along its length and terminating in a pair of tabs, each tab being angled into the interior of the shelving system to form a wing and a wing notch on said tab for engaging a wing of said corner bracket, wherein one of said pair of wings of said corner bracket is resiliently biased to seat in the wing notches of the pair of tabs of one of said pair of collar arms, and the other one of said pair of wings is resiliently biased to seat in the wing notches of the pair of tabs of the other one of said pair of collar arms, and wherein said corner bracket and collar form a generally triangular sleeve around said support post, said sleeve being translated relative to said wedge member and said support post to engage said wedge member and support post and to seat thereon by wedge action at substantially said predetermined position.

35. A shelf support system for a knock-down type shelving system having at least one sheet metal shelf defining an interior and an exterior, the shelf support system comprising:

a support post having a generally right equilateral triangular cross-section, the right angular apex being rounded and, together with the two sides adjacent of said right angular apex, facing the exterior of, said shelf the two remaining interior angular apexes being rounded and symmetrically disposed, and the interior face of said support post, disposed opposite said right angular apex, having a plurality of detent steps periodically disposed along the length of the support post at predetermined intervals;

a molded plastic wedge member, having a resilient contoured lip on each of two opposing edges and at least one detect tab disposed to cooperate with said detent steps on said support post, each lip being formed to embrace an interior angle apex of said support post thereby to removably and adjustably dispose said wedge member on said interior face of said support post by a clip-on operation, the wedge member further having a wedge portion tapered to extend from the top of said wedge member to the bottom of said wedge member in the direction of the interior of the shelf, the wedge portion having a central wedge portion extending across said interior face of said support post when said wedge member is mounted thereon and an side wedge portion adjacent each of said interior angle apexes of said support post, said central wedge portion further having avoid therethrough forming a window for viewing said detent steps disposed on said interior face of said support post, and said central wedge portion still further having a shelf height indicator disposed adjacent said window for indicating a detent step, thus for indicating a predetermined position at which said wedge member is located by said at least one detent tab;

a corner bracket formed in a corner of said at least one sheet metal shelf, the corner bracket having two shelf side walls formed by folding the periphery of the sheet metal shelf and a panel joining said shelf said walls, each side wall having a pair of slots cut therein to comprise a pair of tab locators, and terminating in a flange, each flange being folded into the shelf interior at a generally right angle to the side wall to form a tapered shoulder, wherein each of said tapered shoulders is complementary to, and cooperates with, one of said side wedge portions, and wherein each tapered shoulder is oriented substantially perpendicularly to the other one of said tapered shoulders; and a resilient collar having a rounded exterior apex which corresponds to an apex of the shelf, and a pair of collar arms extending therefrom, each collar arm being tapered and ribbed along its length and terminating in a pair of tabs, each tab being angled into the interior of the shelving system to form a wing and a wing notch on said tab for engaging a tab locator of said corner bracket by a snap-on operation, wherein each tab is resiliently biased to seat in a respective tab locator, and wherein said corner bracket and collar form a triangular sleeve around said support post, said sleeve being translated relative to said wedge member and said support post to engage said wedge member and collar and to seat thereon by wedge action at substantially said predetermined position.

36. A shelf support system for a knock-down type shelving system having at least one plastic shelf defining an interior and an exterior, the shelf support system comprising:

a support post having a generally right equilateral triangular cross-section, the right angular apex being rounded and, together with the sides adjacent said right angular apex, facing the exterior of said shelf, the two remaining interior angular apexes of said support post being rounded and symmetrically disposed, and the interior face of said support post, disposed opposite said right angular apex, having a plurality of detent steps periodically disposed along the length of the support post at predetermined intervals;

a molded plastic wedge member, having a resilient contoured lip one each of two opposing edges and at least one detent tab disposed to cooperate with said detent steps on said support post, each lip being formed to embrace an interior angle apex of said support post thereby to removably and adjustably dispose said wedge member on said interior face of said support post by a clip-on operation, each wedge member further having a wedge portion tapered to extend from the top of said wedge member to the bottom said wedge member in the direction of the interior of the shelf, the wedge portion having a central wedge portion extending across said interior face of said support post when said wedge member is mounted thereon and a side wedge portion adjacent each of said interior angle apexes of said support post, said central wedge portion further having a void therethrough forming a window for viewing said detent steps disposed on said interior face of said support post, and said central wedge portion still further having a shelf height indicator disposed adjacent said window for indicating a detent step, thus for indicating a predetermined position at which said wedge member is located by said at least one detent tab;

a corner bracket integrally molded in a corner of the plastic shelf, the corner bracket having a central tapered face angled at each of two opposing side edges to form a pair of tapered shoulders terminating at a generally right angle to a recess in the adjacent side walls of the plastic shelf, each recess in the side wall having a plurality of shark gill protrusions periodically formed in the side wall at a predetermined interval, each protrusion being generally rectangular but having an interior edge angled toward the interior of the shelf, wherein said central tapered face is complementary to, and cooperates with, said central wedge portion and wherein each one of said pair of tapered shoulders is complementary to, and cooperates with, a side wedge portion, and is oriented substantially normal to an adjacent side edge of the plastic shelf; and a resilient collar having a rounded exterior apex which corresponds to an apex of the shelf, and a pair of collar arms extending therefrom, each collar arm having an upper locator tab, a lower locator tab, a tapered tail, and a plurality of shark gill slots, said upper and lower locator tabs being formed at the upper and lower edges of the collar arm, respectively, and extending into the interior of the shelf at a generally right angle to the collar arm, for locating the corner bracket of said plastic shelf therebetween, said tapered tail corresponding to said molded notch of said recess in the corner bracket, for locating said tapered tail therein, and each of said shark gill slots corresponding to a respective shark gill protrusion, each shark gill slot being generally rectangular but having an interior side angled toward the exterior of the shelf, wherein said collar and said corner bracket may be engaged by a snap-on operation, said shark gill protrusions and shark gill slots engaging in an interlocking manner, to form a generally triangular sleeve around said support post, said sleeve being translated relative to said wedge members and said support post to engage said wedge member and support post and to seat thereon by wedge action at substantially said predetermined position.

37. A system for supporting a shelf having a periphery that defines a plurality of corners and an interior and an exterior of the shelf, said system comprising:

a corner bracket mounted with each said corner of said shelf and having a face portion having at least one surface inclined downwardly and inwardly with respect to said shelf interior;

a plurality of collar, equal in number to the number of said corner brackets, each said collar having two sides that define a generally right angular apex;

means for mounting each said collar with one said corner bracket thereby to form an open sleeve having a generally right triangular cross-section, at least a major part of said face portion defining the hypotenuse and said sides of said collar defining the adjacent sides of said generally right triangular cross-section;

a plurality of support posts, equal in number to the number of said corners brackets, each said support post having two sides surfaces, forming a generally right angular apex, and a hypotenuse surface that together define a generally right triangular cross-section congruent to the cross-section of one said sleeve, each said post thereby being formed to be received in one said sleeve;

a plurality of wedge members, equal in number to the number of said corner brackets, each said wedge member having at least one inclined face complementary to said inclined surface of said face portion; and means for mounting each said wedge member at a fixed location on said hypotenuse surface of one said support post and adjacent said face portion of one said corner bracket, with said inclined wedge portion of said one wedge member inclined downwardly and inwardly with respect to said shelf interior;

whereby downward movement of said shelf with one said support post and one said wedge member mounted thereon received in an associated one of said sleeves causes said wedge portion of each said one wedge member and said inclined surface of said face portion tightly to engage thereby to urge said generally right angular apex of each said one support post into tight engagement with said generally right angular apex of said one collar and said side surfaces of each said one support post into tight engagement with said sides of said one collar.

* * * * *

UNITED STATES PATENT AND TRADEMARK OFFICE

CERTIFICATE OF CORRECTION

PATENT NO. : 4,811,670

DATED : March 14, 1989

INVENTOR(S) : ALBERT KOLVITES, ET AL.

It is certified that error appears in the above-identified patent and that said Letters Patent is hereby corrected as shown below:

On the title page:

IN [73] ASSIGNEE

"Intermetro Industries Corporation," should read --InterMetro Industries Corporation,--.

COLUMN 1

Line 45, "sleeve)" should read --(sleeve)--.

COLUMN 3

Line 53, "eguilateral" should read --equilateral--.

COLUMN 4

Line 18, "support" should read --support system--.
Line 37, "an" should read --is an--.

COLUMN 5

Line 41, "eguilateral" should read --equilateral--.

COLUMN 7

Line 27, "preferrably larger" should read --preferably large--.
Line 63, "an" should read --a--.

UNITED STATES PATENT AND TRADEMARK OFFICE

CERTIFICATE OF CORRECTION

PATENT NO. : 4,811,670

DATED : March 14, 1989

INVENTOR(S) : ALBERT KOLVITES, ET AL.

It is certified that error appears in the above-identified patent and that said Letters Patent is hereby corrected as shown below:

COLUMN 8

Line 55, "position" should read --positioning--.
Line 56, after "posts" insert --,--.
Line 57, after "post" insert --at--.

COLUMN 13

Line 34, "d ®tent" should read --detent--.

COLUMN 15

Line 3, "uilateral" should read --equilateral--.
Line 31, "avoid" should read --a void--.

COLUMN 16

Line 22, "detect" should read --detent--.
Line 34, "an" should read --a--.
Line 37, "avoid" should read --a void--.

UNITED STATES PATENT AND TRADEMARK OFFICE

CERTIFICATE OF CORRECTION

PATENT NO. : 4,811,670

DATED : March 14, 1989

INVENTOR(S) : ALBERT KOLVITES, ET AL. Page 3 of 3

It is certified that error appears in the above-identified patent and that said Letters Patent is hereby corrected as shown below:

COLUMN 18

Line 27, "collar," should read --collars,--.
Line 38, "corners" should read --corner--.
Line 39, "sides" should read --side--.

Signed and Sealed this

Twentieth Day of February, 1990

*Attest:*

JEFFREY M. SAMUELS

*Attesting Officer* *Acting Commissioner of Patents and Trademarks*

UNITED STATES PATENT AND TRADEMARK OFFICE

CERTIFICATE OF CORRECTION

PATENT NO. : 4,811,670

DATED : March 14, 1989

INVENTOR(S) : ALBERT KOLVITES ET AL.

It is certified that error appears in the above-identified patent and that said Letters Patent is hereby corrected as shown below:

COLUMN 12

Line 17, "thereby to for an" should read --thereby to form an--.

Line 50, "side support posts" should read --side support post surfaces--.

COLUMN 13

Line 21, "inditia means" should read --indicia means--.

COLUMN 14

Line 26, "each wind being" should read --each wing being--.

Signed and Sealed this

Twelfth Day of May, 1992

*Attest:*

*Attesting Officer*

DOUGLAS B. COMER

*Acting Commissioner of Patents and Trademarks*